United States Patent [19]

Poss

[11] 4,277,855

[45] Jul. 14, 1981

[54] PORTABLE SAUNA

[76] Inventor: Glen Poss, c/o Crown Dental Labs, W. 508 Sixth Ave., Spokane, Wash. 99204

[21] Appl. No.: 115,394

[22] Filed: Jan. 25, 1980

[51] Int. Cl.[3] ..... A61H 33/02

[52] U.S. Cl. ..... 4/524; 4/531; 4/532; 128/371; 128/376; 128/367

[58] Field of Search ..... 4/524, 525, 526, 528, 4/529, 531, 532, 533; 128/371, 372, 376, 367

[56] References Cited

U.S. PATENT DOCUMENTS

| | | | |
|---|---|---|---|
| 871,074 | 11/1907 | Stockton | 4/524 |
| 3,271,786 | 9/1966 | Soy | 4/532 |
| 3,275,800 | 9/1966 | Kuoppamaki | 4/524 X |
| 3,309,503 | 3/1967 | Dow et al. | 4/524 X |
| 3,422,465 | 1/1969 | Jones et al. | 4/532 |
| 3,685,060 | 8/1972 | Bemberg | 4/524 |

FOREIGN PATENT DOCUMENTS

| | | | |
|---|---|---|---|
| 2123739 | 12/1972 | Fed. Rep. of Germany | 4/524 |

*Primary Examiner*—Henry K. Artis
*Attorney, Agent, or Firm*—Wells, St. John & Roberts

[57] ABSTRACT

A portable sauna is described, being formed in the shape of a sphere. A door leads into a spherical shaped room wherein a bench extends about a central circular floor. Above the bench is a loft lying adjacent a plane that passes through the center point of the spherical shape. The sauna may be selectively heated by any combination of heat lamps, dry heated air blower, and a steam generator, all of which operate on common household current. Water for the steam generator is supplied by a self-contained reservoir. Ventilation can be controlled by the occupant through a skylight ventilator or automatically through a valve mechanism interconnected with the blower. The valve mechanism is operable to recirculate room air or to receive indirect outside air into the room. Selectively controlled lighting and audio systems are also included to allow further control of the enclosed environment.

20 Claims, 7 Drawing Figures

PORTABLE SAUNA

BACKGROUND OF THE INVENTION

The present invention is related to portable saunas and steam bath structures.

The sauna and steam bath both have well known physiological restive affects. Tension and other physical stress is relieved through the dry heated air of a sauna or the heavy moist air of a steam bath.

Until now the desirable effects produced by saunas and steam baths have been offset by the problems of effective design, efficient use of space and economics.

Saunas and steam baths are popularly known to be integral "rooms" of exclusive homes, fitness centers or health spas. Portable saunas and steam baths have been developed (reference U.S. Pat. Nos. 3,271,786 and 3,707,732) but their portability is directly dependent upon their small size—only one person can make use of the device at any given time. Saunas and steam baths both are much more enjoyable and effective when they can be occupied by more than one person. Furthermore, the closed cramped quarters of a typical portable sauna can, at least with some people, cause more tension than the therapeutic effect of the sauna or steam bath can remove. Portable saunas thus have had limited value, psychologically if not physiologically.

The present invention meets human needs for both physiological and psychological pleasure and relaxation within a defined space of soothing shape and texture. It remains very practical in its portability, structural stability, use of household current, and nonrequirement of plumbing connections; yet it gives one or preferably several people the opportunity to select an environment to match nearly any mood.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
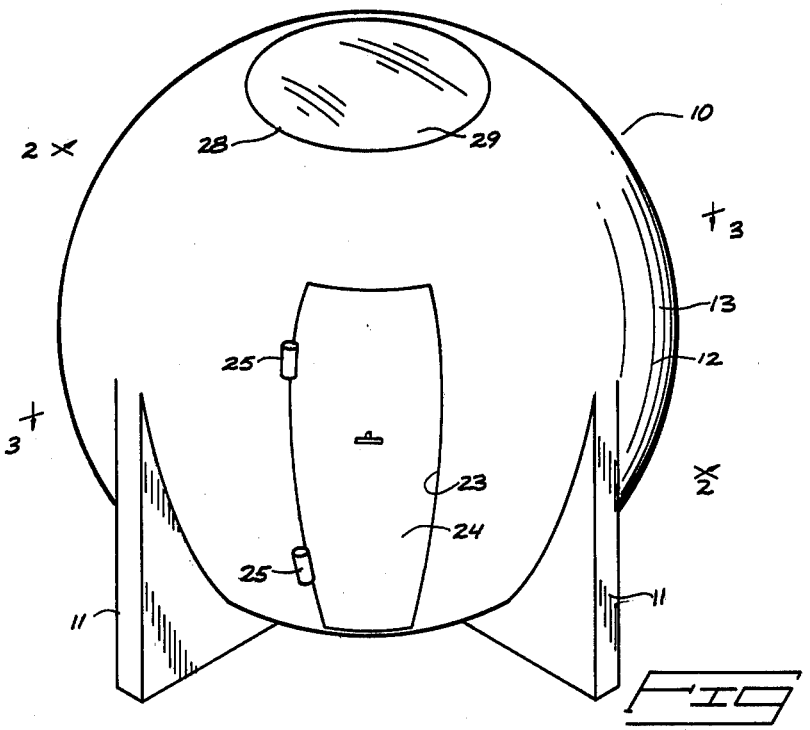
FIG. 1 is a pictorial view of the exterior configuration of the present sauna.

The present "sauna" is designated generally by the reference character 10 in the accompanying drawings. The present invention broadens the general concept of the term "sauna" by adding significantly to the presently known dry heat room or steam bath. The result is a novel "sauna" 10 in which the user can selectively control sensory input to affect his overall physiological as well as psychological enjoyment and relaxation.

The sauna is comprised basically of a ball shaped structure 12 supported externally by an upright framework 11. The framework 11 may be formed integrally with the structure, extending downwardly to flat, horizontal surfaces that brace the ball shaped structure from rolling. The structure 12 includes a spherical external wall 13 that encloses or circumscribes a complementary spherical inner wall 14. The interior wall defines a spherical shaped room 15.

The spherical walls 13 and 14 are formed of synthetic resinous shells, preferably by a vacuum forming process. The walls are preferably formed in two hemispheres and joined together during assembly of a sauna unit.

The two walls are connected at a joint 20 in a plane common to both sets of hemispherical wall sections. The two hemispherical sections can be permanently or temporarily joined together at the joint 20.

The void or space between the inner and outer walls 13 and 14 is filled by an insulative material 16. It is preferred that this material 16 be of the foamed resin variety, providing high heat insulative values as well as acoustical insulation of the room 15 from the external atmosphere. Furthermore, such foamed insulation has structural properties that, together with the structural stability imparted through the walls 13 and 14, add to the entire structural integrity of the unit.

Figure 3:
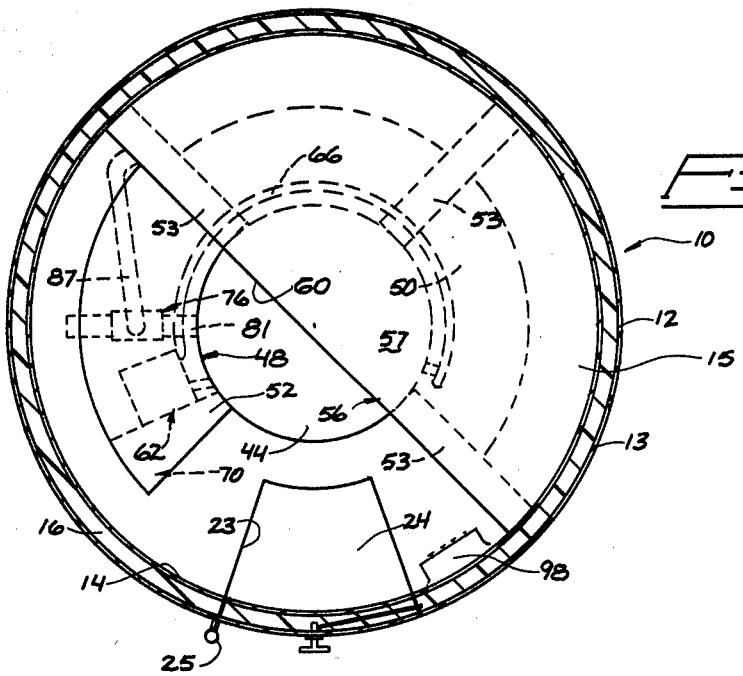
FIG. 3 is a horizontal sectional view taken along line 3—3 in FIG. 1.

A doorway 23 (FIGS. 1 and 3) is formed through the structure 12 leading into the room 15. The doorway 23 is selectively closed by a door 24. Appropriate sealing material (not shown) may be provided about the mating surfaces of the door and doorway to provide an airtight seal.

The door 24 is formed with the curvature of the walls 13 and 14 so as not to interrupt the spherical shape of the structure externally, nor the spherical shape of the room 15. The door is shown as being a single piece structure. However, it is conceivable that the door may be formed by more than one hinged element. For example, the door can be divided horizontally at its approximate midsection with an upper half foldable upwardly to open the upper half of the doorway and to provide overhead protection to the user. The bottom half would be hinged and folded downwardly, providing a ramp leading into the room 15. Other forms of unitary, split hinged, or sliding doors are also contemplated.

The single piece door 24 shown in the drawings is hinged at 25 to the ball shaped structure 12. The hinges protrude outwardly from the external wall 13 to define an upright axis about which the door will swing.

Upward of the doorway 23 along the structure 12 is a skylight 28. The skylight 28 includes a smoothly curved dome 29 formed of a transparent material, preferably a transparent variety of the same material utilized to form the walls 13 and 14. The curvature of the dome 29 is continuous with the curvature of the external wall. The dome is received within a recess 30 formed in the outer wall 13 so as not to interrupt the spherical appearance of the structure from the outside. The recess can be lined with appropriate weather stripping 32 to seal the dome 29 and exterior wall 13.

The dome 29 is centered on an upright central axis that passes vertically through the common center of the spherical walls 13 and 14. Also centered on this axis is a circular opening 31 extending between the walls 13 and 14. The dome 29 covers opening 31.

Dome 29 is mounted to a sleeve 33 (FIG. 6) received within the opening 31 for sliding movement toward and away from the room 15. The sleeve 33 slides frictionally and axially along the central upright axis to lift the dome 29 to the dotted line position as shown in FIG. 6 or to lower the dome into flush engagement with the exterior wall 13.

A first inner transparent pane 34 is formed across the sleeve 33 hermetically sealing the area between the pane 33 and adjacent surface of the dome 29. A second circular transparent pane 35 is spaced axially from the first pane 34. Sleeve 35 creates a second hermetically sealed area between the panes 34 and 35. There is a double insulation factor, therefore, between the exterior atmosphere and the inside environment of the room 15.

The second pane 35 is preferably formed of a polarized material. A third transparent pane 36 is rotatably mounted to the second pane 35 and is also formed of polarized material. The pivot connection 37 is positioned on the upright axis passing through the center point of the walls 13 and 14. A handle 38 is provided on the third pane 36 outward of the pivot 37 to enable rotational movement of the third pane 36 relative to the second pane. Rotational movement or angular positioning of one polarized pane relative to the other will correspondingly effect the amount of light allowed to enter the room through the skylight 28. The user can therefore selectively determine the amount of external light admitted into the room 15 simply by rotating the third pane 26 about the upright central axis.

Figure 6:
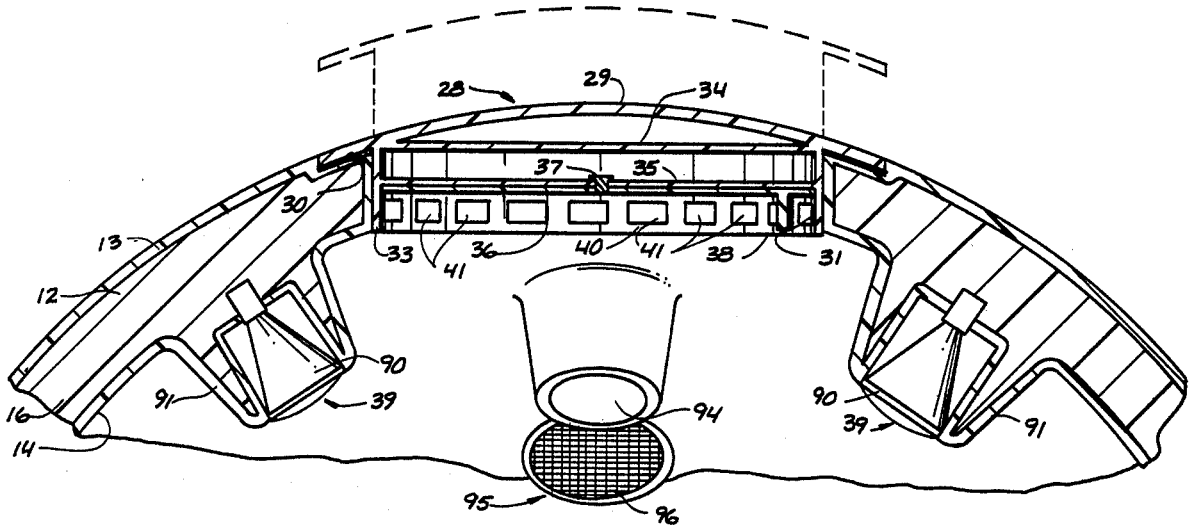
FIG. 6 is an enlarged fragmentary sectional view showing a skylight and adjacent elements.

A lower portion of the sleeve 33 includes a vent means generally shown at 40 in FIG. 6. The vent means 40 is simply comprised of a number of openings 41 formed through the sleeve about its periphery. These openings 41 can be moved upwardly with the sleeve to become exposed to the outside air and allow free passage of air to and from the room 15. The amount of ventilation depends on the axial position of the sleeve. A fully open position is shown by the dashed line position of FIG. 6.

One entering the room 15 through the doorway 23 will step firstly on a circular floor 44. The floor 44 is formed integrally within the inner shell that defines the wall 14. The circular floor 44 is centered on the upright central axis. It may be partially covered by a decking (not shown) that will elevate the user's feet from condensate that can collect within the room following use with steam.

A bench 48 extends about the upright axis and about the periphery of the floor 44. The bench is split into different levels about the axis. A high or upper level 49 of the bench extends partially about the arc formed by the bench 48 with the remaining bench portion made up by a lower bench level 50. Both levels 49 and 50 are determined by an upright front wall 51 of the bench. The wall 51 is formed integrally with the inner wall and defines a hollow space between it and the adjacent portions of the curved wall 14. Horizontal seats 52 extend between the upright front wall 51 and inner wall 15 to provide support to the user. The seats 52 are supported, at least partially, by dividers 53 that extend radially with respect to the central upright axis of the room. The dividers 53 are formed to provide arm rest sections 54 and integral upright structural braces 55.

Figure 2:
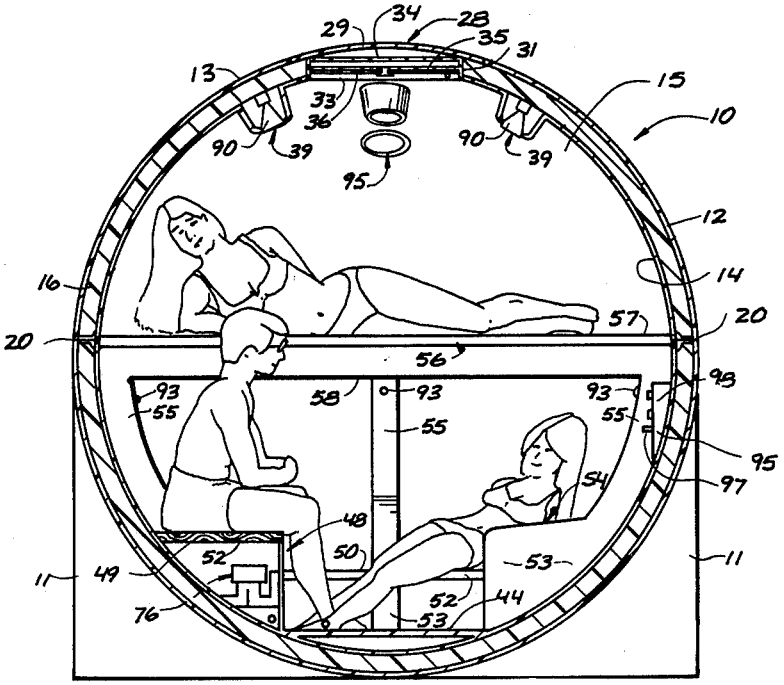
FIG. 2 is a sectional view taken along line 2—2 in FIG. 1.

The structural braces 55 support a loft 56 that is located above the bench 44 on a horizontal plane situated elevationally adjacent the center point for the spherical inner curvature of the room. The loft is preferably formed of a wooden plank platform 57 supported by the braces 55 and additional supports such as horizontal beams 58 (FIG. 2). It is pointed out that the beams 58 may be integral with either of the hemispheres or separate from both. If separate, the platform can be mounted to the lower hemisphere prior to positioning of the upper hemisphere along the joint 20.

A forward edge 60 (FIG. 3) of the loft 56 passes through or is adjacent to the center point of curvature within the room 15. The edge 60 is located directly above the upper level 49 of bench 48. The elevational difference between the floor 44, upper bench level 49, and loft 56, is such that it is relatively easy for a user to step up onto the upper bench level 49 and sit or slightly lift himself onto the loft surface.

The loft 56 spans a substantial (semi circle) area within the room 15 and therefore can provide support for one or more persons either lying separately or sitting on the loft surface.

Figure 7:
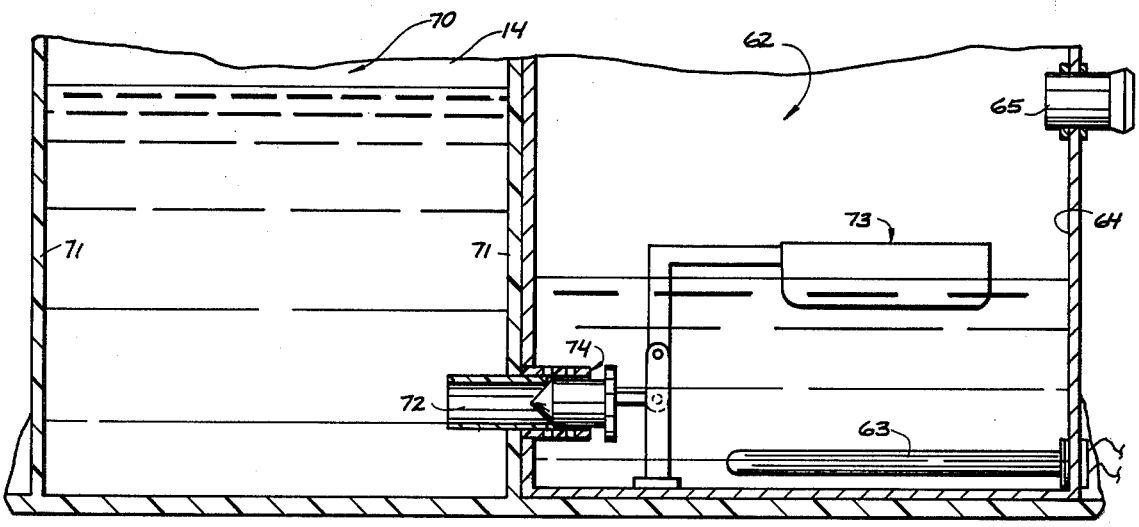
FIG. 7 is an enlarged sectional view showing a water reservoir and steam generator of the present invention.

The atmosphere within the room 15 can be selectively changed through selective use of three different room temperature controlling mechanisms. Firstly, a steam generator (FIG. 7) is provided at 62 for selectively increasing the humidity within the room 15. The generator 62 is formed within the confines of the bench 48 between the front wall 51 and inner wall 14 of the structure. The steam generator 62 includes a standard electrical resistive heat element 63 that operates from standard household current. The element 63 is submersible and is selectively covered with water within a water chamber 64. The chamber 64 is shown as a metal chamber. However, it is contemplated that the chamber may be supplied as an integral part of the structure between the wall 51 and internal wall 14.

Figure 4:
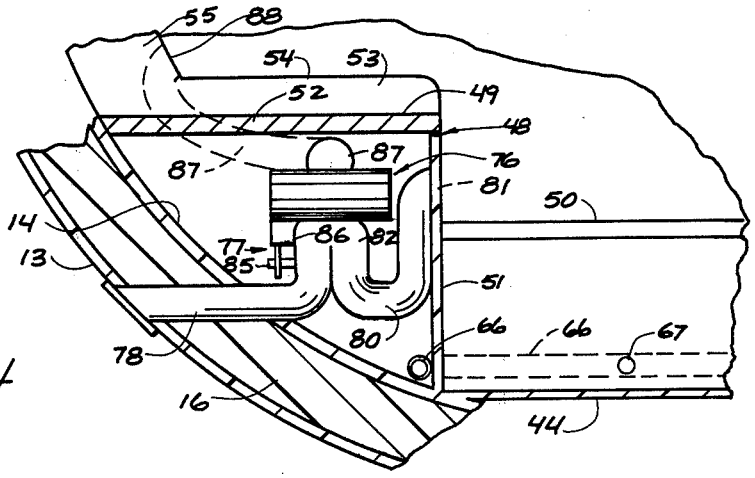
FIG. 4 is an enlarged fragmentary view of a bench and an air valve mechanism.
Figure 5:
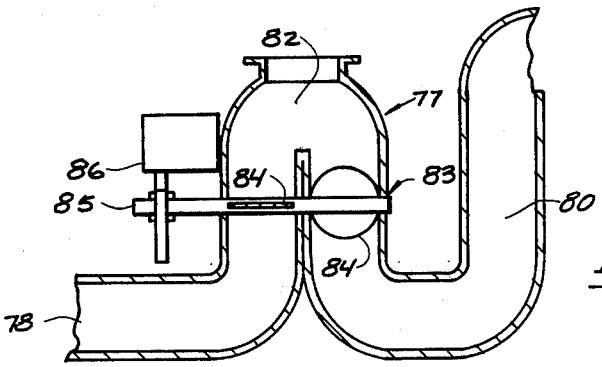
FIG. 5 is an enlarged sectional view taken on a vertical plane through the valve mechanism of FIG. 4.

A steam discharge 65 leads from the water channel 64 to direct steam through a conduit 66 (dashed lines, FIG. 5). The conduit 66 leads around the wall 51 on an interior surface thereof to several angularly spaced discharge orifices 67 (FIG. 4). The orifices 67 are preferably situated adjacent to the floor 44.

Water is supplied to the steam generator 62 through a water reservoir 70. The reservoir 70 is preferably defined by substantially radial partitions 71 (FIG. 7) that extend between the upright wall 51 and adjacent areas of the interior spherical wall 14. It is preferred that the water reservoir 70 hold and store several gallons of water so that refilling will not be necessary for each use of the present sauna.

A water inlet 72 is provided between the water reservoir 70 and the water chamber 64. Flow of water through the inlet 72 from the reservoir is controlled by a float mechanism 73. The mechanism includes a float valve 74 that is opened when the water level within the water chamber 64 falls below a selected level. Water can then fill the chamber 64 back up to its desired level by gravity flow from the reservoir.

A second source of heat includes a blower and air heater means 76 that is positioned below the bench seat 52 adjacent to the steam generator 62 (FIG. 4). The blower and air heater means may be separate or integral mechanisms so the blower can be used independently of or in conjunction with the heater to circulate cool or heated air throughout the room 15. The blower and heater means 76 may comprise a conventional squirrel cage fan unit mounted adjacent to a standard electrical resistance heater. It is preferred that both the blower and heater units operate on standard household current.

An air valve means is provided at 77 for selectively directing air to the blower and air heater means 76. The air valve means 77 includes an outside air duct 78 leading from an external opening to an air inlet of the blower and air heater. An inside air duct 80 is also provided, opening at 81 (dashed lines, FIGS. 3 and 4) into the room for receiving and recirculating air from within the room to the heater and blower. The ducts 78 and 80 are joined at a common manifold 82. A closure means 83 is situated within the manifold and is selectively operable to close one of the ducts while opening the other.

The closure means 83 is simply comprised of a butterfly disk 81 for each duct 78 or 80. The butterfly disks 84 are interconnected by a single rod 85. The rod rotates the disks along a common axis. The disks are mounted on the rod 85 at right angles to one another. With this angular relationship pivotal movement of one disk to close its associated duct will cause the opposed disk to open the duct associated therewith. An actuator 86 in the form of a solenoid or other appropriate motion transmitting mechanism may be provided to automatically rotate the rod in response to automatic actuation through appropriate thermostatic control or by manual actuation by the user.

The output side of the blower and air heater means 76 is connected to ducts 87 that lead to exhaust openings 88, one of which is shown in FIG. 4. The opposite opening is directly opposite. The ducts 87 each extend upwardly inside the structural braces 55 to avoid reducing the wall thickness or insulation depth between the internal wall 14 and external wall 13.

A third source of heat is supplied by radiant heat means 39. Preferably, the radiant heat means includes one or more heat lamps 90 situated upwardly of the loft 56 along the internal wall 14. The heat lamps 90 are situated within cowlings 91 formed integrally with the wall 14. The heat lamps are directed inwardly and toward the center point of the structure. The radiant heat from lamps effectively increases the temperature within the room 15. The heat lamps are selected to operate from standard household current.

Incandescent lights 93 are provided along each of the structural braces 55 and can be selectively operated to provide primary light within the room.

Also situated along the interior wall 14 are a pair of sunlamps 94. One lamp 94 is shown in FIGS. 2 and 6. The lamps 94 fit within cowlings 91 and are directed toward the loft area 56 and the room center. The sunlamps can be operated periodically to supply ultraviolet radiation for body tanning purposes.

An audio system is also supplied at 95 having one or more speakers 96 mounted to the interior wall 14 above the loft 56. A sound reproducing unit 97 is situated at a central control panel 98. The unit 97 may be any appropriate system including radios, cassette decks, etc.

The control panel 98 is located to provide central control of the various different operational systems. Appropriate switches and various control mechanisms may be provided to manually select the atmosphere desired within the room 15, or appropriate automatic control systems can be provided to allow the user to simply select any one of several preprogrammed environments.

The present sauna may be manufactured as a complete unit or can be supplied in "kit" form with the two hemispheres initially separated. The "kit" can be constructed simply by placing the upper hemisphere over the lower hemisphere and securing the joint by anyone of several conventional securing mechanisms, including glue, bolts, fiberglass, etc. Electrical connections may be made by appropriate plugs (not shown) to interconnect the control panel 98 and power supply with the electrical appliances situated within the upper hemisphere.

The upper hemisphere must be positioned so the sides of the door are in proper alignment. The next step in construction, then, will be hanging of the door. This procedure, with the hinges shown, is simply a matter of placing the door in position and inserting the conventional hinge pins through the spaced hinge members.

Following assembly, a sauna unit may be connected to a standard outlet for conventional household current.

As a final preparation step, the user may wish to fill the water reservoir 70 with water. The reservoir can be filled simply by removing the adjacent seat 52 and pouring water into the reservoir. The reservoir permits use of the steam generator without requiring that the entire sauna unit be plumbed to receive a continuous supply of water. Experimental use with a prototype has shown that as little as five gallons of water is required for continuous steam operation through an 80 hour period. Therefore, the reservoir does not require frequent refilling.

The present sauna can be used by one or, preferably, several people. Three people are shown in the sectional view in FIG. 2. One occupant is shown seated on the upper bench 49. Another is reclining on lower level 50, while a third is lying on the loft 56.

A prototype of the present sauna having an internal diameter of 7 feet 9 inches is very comfortable for several people in addition to the three shown. Experimental use has shown that up to 12 people may occupy the present sauna, (within the 7 feet 9 inch diameter room 15) without discomfort.

The upper bench level 49 will receive and support one or more people in a sitting position. Additional people may sit or recline at the lower bench level 50. A reclining person is assisted by the outwardly flaring wall 14 which provides a backrest above the horizontal bench surface of seats 52.

Upon closing the door 24, the user finds himself within a substantially spherical enclosure. The effect of the spherical shaped walls has typically produced a psychologically comforting effect. Studies have shown this experience stems from the prenatal confines of the womb. This, then, begins the overall psychological and physiological relaxation experience that is offered by the present sauna.

Once in the room, the user can select an environment that can be altered in terms of temperature, humidity, type and intensity of light, interior sounds, and his own physical position in relation to the various sensory affecting components.

For example, the user may merely wish to occupy the room without using any of the available heating units. In such a case, the heat lamps, air heater and steam generator, are not operated. The air valves means 77 can be selectively controlled to direct outside air to the independently controlled blower 76 so that cool circulating air may be directed throughout the interior of the sauna. Such outside air can be selectively vented out the top of the room by moving the vent means within the dome to an open, operative position (see dashed lines FIG. 6). The user can select the amount of exterior light entering the sauna simply by rotating the polarized pane 36. He can further control lighting within the room 15 by selectively operating the available lights 93. The audio system may also be selectively operated according to the user's choice.

If the user or users wish to experience the present sauna in a heated environment, any one or a combination of the individual heating units can be utilized for that purpose. For example, if dry heat is desired, the air heater and blower can be used, or the heat lamps can be used, or both can be used together. Both the air heater-blower and heat lamps operating together can produce conventional sauna bath temperatures at low humidity within the room. It is pointed out that this is accomplished using standard household current.

If the users desire to experience a high humidity atmosphere within the room, the steam generator is used alone or in combination with any one or more of the remaining heating units. An interesting effect, however, is produced when the steam generating unit is utilized in conjunction with the heat lamps. The soft colors of the heat lamp are reflected by the steam within the room to produce a warm, overall glow throughout the room interior. Furthermore, the radiant heat from the lamps serves to heat and maintain the steam in suspension within the room atmosphere. If increased heat is desired, the air heater and blower means can be actuated.

Because the sauna is totally self-contained, the user need only plug it into a standard electrical outlet. No wiring, plumbing or remodeling of existing premises is required. The present sauna, due to the heat insulative capacity between the walls 13 and 14, can operate efficiently as a sauna in outside temperatures even below freezing.

The above description is given by way of example to set forth a preferred form of the present invention and several of the many therapeutic functions it provides. Other forms and modifications may be made within the scope of my invention. Therefore, the following claims more specifically define the scope of my invention.

What I claim is:

1. A portable sauna, comprising:

a support frame;

a hollow ball shaped structure on the support frame having a substantially spherical exterior wall and an inwardly spaced interior wall defining a substantially spherical room, formed about a center point;

a door hinged to the compartment allowing access to the room;

a floor surface within the room;

a bench extending about the floor on an arc centered on an upright axis passing through the center part of the room adapted to support one or more people in a sitting or reclining position;

a loft above the bench opposite the door and adjacent a horizontal plane passing through the center point of the room adapted to support one or more persons in sitting, prone, or reclining positions;

a steam generator having a steam outlet within the room;

reservoir means for supplying water to the steam generator;

means above the loft along the interior wall for radiating heat into the room;

blower means for circulating air within the room; and heater means associated with the blower means for selectively heating the air passing through the blower.

2. The portable sauna as defined by claim 1 further comprising outside air valve means associated with the blower means and selectively operable to recirculate air from within the room through the blower means or to direct air from outside the structure to the blower.

3. The portable sauna as defined by claim 1 further comprising skylight means above the loft within an opening formed through the structure allowing light to enter the room.

4. The portable sauna as defined by claim 3 wherein the skylight means includes polarizer plates extending across the opening and rotatable relative to one another to selectively vary the amount of light entering the room.

5. The portable sauna as defined by claim 3 further comprising vent means associated with the skylight means for selectively opening the room interior to the exterior atmosphere.

6. The portable sauna as defined by claim 1 further comprising a sunlamp mounted to the interior wall above the loft and directed toward the area of the loft.

7. The portable sauna as defined by claim 1 further comprising:

air valve means associated with the blower means, including:

a first duct in open communication with the atmosphere outside the structure and a second duct in open communication with the atmosphere inside the room;

closure means in each duct selectively operable to open or close the duct; and actuator means associated with the closure means in both ducts for simultaneously causing the closure means to close off one duct while opening the other and vice-versa.

8. The portable sauna as defined by claim 1 wherein the steam generator and water reservoir are interconnected by a float within the steam generator and a float valve on the reservoir operated by the float to allow flow of water from the reservoir into the steam generator to a selected level.

9. The portable sauna as defined by claim 1 wherein the bench includes a curved upright axial wall extending upwardly from the interior wall of the structure adjacent the floor, and a horizontal arc seat extending horizontally from the upright axial bench wall to the interior wall of the structure.

10. The portable sauna as defined by claim 9 wherein the water reservoir is defined by the interior wall of the structure below the bench seat, the upright axial wall of the bench, and substantially radial partition walls extending across the bench from the interior structure wall to the upright axial bench wall.

11. The portable sauna as defined by claim 9 wherein the steam generator, blower means and heater means are situated within the bench below the seat thereof.

12. The portable sauna as defined by claim 9 wherein the steam generator includes a steam conduit having steam discharge orifices formed through the upright axial bench wall adjacent the floor.

13. The portable sauna as defined by claim 1 wherein the means for radiating heat into the room is comprised of a heat lamp mounted to the interior wall of the structure above the loft and directed toward the center point of the spherical room.

14. The portable sauna as defined by claim 1 further comprising an audio system formed integrally with the structure and having a control panel on the interior wall adjacent to loft and speakers on the interior wall above the loft.

15. The portable sauna as defined by claim 1 wherein the heater means, blower means, heat radiating means, and steam generator are electrically operated using standard household current.

16. The sauna as defined by claim 1 further comprising an opening extending through the structure and opening into said room;

a sleeve, complementary to said opening mounted within the opening for sliding movement toward and away from said room;

vent holes formed through said sleeve and positioned thereon to be selectively exposed outside the structure upon movement of the sleeve away from said room, thereby venting the room to the exterior atmosphere.

17. The sauna as defined by claim 16 further comprising skylight means covering said sleeve for admitting light into said room from outside the structure.

18. The sauna as defined by claim 17 further comprising window pane spanning the sleeve inward of said skylight means and hermetically sealing an area between said pane and skylight means.

19. The sauna as defined by claim 18 further comprising light polarizing means on the sleeve for admitting a selected amount of light into said room.

20. The sauna as defined by claim 16 further comprising light polarizing means on the sleeve for admitting a selected amount of light into said room.

* * * * *